US005852302A

United States Patent [19]

Hiraishi et al.

[11] Patent Number: 5,852,302

[45] Date of Patent: Dec. 22, 1998

[54] CYLINDRICAL MULTIPLE-POLE MASS FILTER WITH CVD-DEPOSITED ELECTRODE LAYERS

[75] Inventors: Masahiro Hiraishi, Kyoto; Toshihiko Yoshida, Uji; Hiroaki Waki; Sunao Yoshida, both of Kyoto; Shinichi Kuroda, Ibaraki, all of Japan

[73] Assignee: Shimadzu Corporation, Kyoto, Japan

[21] Appl. No.: 785,298

[22] Filed: Jan. 21, 1997

[30] Foreign Application Priority Data

Jan. 30, 1996 [JP] Japan ..... 8-037514
May 29, 1996 [JP] Japan ..... 8-158867

[51] Int. Cl.[6] ..... H01J 49/42

[52] U.S. Cl. ..... 250/292; 313/256

[58] Field of Search ..... 250/292, 293, 250/290; 313/256

[56] References Cited

U.S. PATENT DOCUMENTS

| | | | |
|---|---|---|---|
| 3,699,330 | 10/1972 | McGinnis | 250/292 |
| 3,793,063 | 2/1974 | Wiley | 250/292 |
| 4,885,500 | 12/1989 | Hansen et al. | 250/292 |
| 5,298,745 | 3/1994 | Kernan et al. | 250/292 |
| 5,373,157 | 12/1994 | Hiroki et al. | 250/292 |
| 5,525,084 | 6/1996 | Broadbent et al. | 250/292 |
| 5,616,919 | 4/1997 | Broadbent et al. | 250/292 |

FOREIGN PATENT DOCUMENTS

| | | |
|---|---|---|
| A-0-556-411 | 8/1993 | European Pat. Off. . |
| A-63-152846 | 6/1988 | Japan . |
| A-6-243822 | 9/1994 | Japan . |
| 2-287-823 | 9/1995 | United Kingdom . |

OTHER PUBLICATIONS

Burzynski "Microprocessor controlled quadrupole mass Spectrometer" vacuum/vol. 32/No. 3/pp. 163–168/Mar. 1982/Great Britain.

*Primary Examiner*—Kiet T. Nguyen
*Attorney, Agent, or Firm*—Oliff & Berridge, PLC

[57] ABSTRACT

A quadrupole mass filter, or a multiple-pole mass filter in general, composed of a cylindrical main body made of an insulating material and having a star-shaped cross-sectional profile whose inward bulges are curved substantially hyperbolic, and four electrode layers of a high melting point metal deposited by a chemical vapor deposition (CVD) process. The four electrode layers are separated at the outward bulges of the star-shaped cross-sectional profile. The quadrupole mass filter has pre-rod electrodes.

12 Claims, 7 Drawing Sheets

CYLINDRICAL MULTIPLE-POLE MASS FILTER WITH CVD-DEPOSITED ELECTRODE LAYERS

The present invention relates to a quadrupole mass filter, or a multiple-pole mass filter in general, which is used to separate ions according to their mass/charge ratio.

BACKGROUND OF THE INVENTION

A conventional quadrupole mass filter has a structure as shown in FIG. 9. Four rod electrodes 52*a,* 52*b,* 52*c* and 52*d* are set parallel to one another, placed symmetrically around a central axis, and fixed by a pair of non-conductive (usually ceramic) holders 51 and 51. When it is used, a combined voltage of a positive DC (direct current) voltage and a high-frequency AC (alternating current) voltage is applied to a pair of opposing rod electrodes 52*a* and 52*b,* and another combined voltage of a negative DC voltage and another high-frequency AC voltage having the same frequency but shifted 180° in phase is applied to the other pair of opposing rod electrodes 52*c* and 52*d.* When various ions are injected from an ion source into the space surrounded by the four rod electrodes 52*a*–52*d* along the central axis, ions having larger masses are attracted by the DC voltage and trapped by the rod electrodes 52*a*–52*d*, and ions having smaller masses are attracted by the high-frequency AC voltage and trapped by the rod electrodes 52*a*–52*d.* Thus, only ions having an appropriate intermediate mass can pass through the space surrounded by the four rod electrodes 52*a*–52*d* along the central axis.

Theoretically, the ideal shape of the inner surfaces (i.e., the surfaces that face the central axis) of the four rod electrodes 52*a*–52*d* is hyperbolic, i.e. each of the surfaces is generated by a translation of a hyperbola along the normal to the plane of the hyperbola, or the central axis. Actually it is difficult, though, to form an exact shape of such a special curve out of a metallic rod, and it is also difficult to set the cusps of all the four hyperbolae come exactly closest to the central axis. Thus the rod electrodes are conventionally formed as simple circular cylinders, which deteriorates the sensitivity of the ion detection. The sensitivity of the ion detection also deteriorates when the four rod electrodes 52*a*–52*d* are not exactly symmetrical or not exactly parallel. This makes the assembling of the four rod electrodes difficult and lowers the manufacturing efficiency of the quadrupole unit 50.

A new form of quadrupole mass filter was proposed to overcome the problems. Japanese Publication No. S63-152846 of Unexamined Patent Application (which claims Convention priority of the U.S. patent application Ser. No. 86/926056) shows a quadrupole mass filter 60 as shown in FIG. 10A, which has a cylindrical glass body 61 formed in vacuo to have four hyperbolic inward bulges in the inner surface. In the quadrupole mass filter 60, silver tapes 62*a,* 62*b,* 62*c* and 62*d* are attached on the surface of the four inward bulges, and the glass body 61 is heated at high temperature to fix the silver tapes 62*a*–62*d* to form four separate longitudinal electrodes. At the four outward bulges of the inner surface of the glass body 61, high-resistance paste 63 such as by zirconium oxide (ZrO) is applied in order to electrically separate the electrodes 62*a*–62*d.*

Though, in the above quadrupole mass filter 60, the glass body 61 can be formed to have ideal hyperbolic shape in the inner surface, it is difficult to control the thickness of the electrodes 62*a*–62*d.* Therefore the resultant shape of the inner surfaces of the electrodes 62*a*–62*d* is not ideal, and the sensitivity is not improved so much. Another disadvantage in the above quadrupole mass filter 60 is that the silver tapes 62*a*–62*d* are apt to be contaminated in the heat-fixing process of the quadrupole manufacturing.

A modification to the above quadrupole mass filter is shown in Japanese Publication No. H6-243822 of Unexamined Patent Application (which claims Convention priority of the U.S. patent application Ser. No. 92/984610). In this quadrupole mass filter 65 as shown in FIG. 10B, a titanium-tungsten (Ti-W) thin layer 66 is formed by sputtering first at the four inward bulges of the inner surface of the glass body 61, a gold (Au) thin layer 67 is formed also by sputtering on the Ti-W thin layer 66, and then gold or other well-conductive metallic material is plated 68 on the gold sputtered layer 67 to form the surface of the electrodes 69*a,* 69*b,* 69*c* and 69*d.* That is, the sputtered metallic thin layers 66 and 67 are used as substrates to enhance the adhesion of the plated metallic layer 68.

Though sputtering generally requires a long time, the forming of the sputtered layers 66 and 67 in the above process need not be long because the sputtered layers 66 and 67 can be thin. And the time needed to plate electrodes 68 is short. Thus the manufacturing efficiency of the quadrupole mass filter 65 is rather high. But the manufacturing process of it is complicated, and the thickness control of plating 68 is difficult. Again in this case, high sensitivity is hard to obtain.

Meanwhile, another type of quadrupole mass filter 70 is shown in FIG. 11 in which four short electrodes (pre-rod electrodes) 73*a,* 73*b,* 73*c* and 73*d* are provided just before the four (main) electrodes 72*a,* 72*b,* 72*c* and 72*d.* When a high-frequency AC voltage alone is applied to the pre-rod electrodes 73*a*–73*d,* more precise ion separation can be achieved. The main electrodes 72*a*–72*d* are usually made of molybdenum and the pre-rod electrodes 73*a*–73*d* are usually made of stainless steel.

In this type of mass filter 70, the four main electrodes 72*a*–72*d* must be placed exactly in the above-explained position, and further the four pre-rod electrodes 73*a*–73*d* must be placed in an exact position correlating to the main electrodes 72*a*–72*d.* Thus, currently, the mass filter of this type is assembled as follows. First the four main electrodes 72*a*–72*d* are positioned exactly and are fixed in the position. A two-faced fixing adapter made of an insulating material is fixed at an end of each of the main electrodes 72*a*–72*d*, and then each rod of the pre-rod electrodes 73*a*–73*d* is inserted into the other hole of the fixing adapter. Such an assembling work is more complicated than the simple quadrupole mass filter 50 as shown in FIG. 9, so that the work requires skill and takes a lot of time.

SUMMARY OF THE INVENTION

An object of the present invention is therefore to provide a quadrupole mass filter, or a multiple-pole mass filter in general, of the normal type and the pre-rod type that has a high detecting sensitivity and that can be manufactured easily at high efficiency and low cost.

Another object of the present invention is to provide a method suited for producing such multiple-pole mass filters.

Therefore, a multiple-pole mass filter according to the present invention includes:

- a cylindrical main body made of an insulating material having a star-shaped cross-sectional profile whose inward bulges are curved substantially hyperbolic; and
- an electrode layer of a high melting point metal deposited also by a chemical vapor deposition (CVD) process on each of the inward bulges, wherein neighboring electrode layers are separated at an outward bulge of the star-shaped cross-sectional profile between the neighboring electrode layers.

A pre-rod type multiple-pole mass filter according to the present invention further includes a pre-rod electrode layer of a high melting point metal deposited by a chemical vapor deposition (CVD) process for each of the electrode layers (main electrode layers) formed adjacent to the main electrode layer with a gap in between.

And a method of producing a multiple-pole mass filter according to the present invention includes the steps of:

forming a main body with an insulating material, wherein the main body has a star-shaped cross-sectional profile whose inward bulges are curved substantially hyperbolic; and depositing an electrode layer of a high melting point metal with a chemical vapor deposition (CVD) process on each of the inward bulges, wherein neighboring electrode layers are separated at an outward bulge of the star-shaped cross-sectional profile between the neighboring electrode layers.

Since the main body can be made to have precisely the ideal curve and the electrode layer can be very thin according to the present invention, the surface shape of the electrode layer can be ideal. Thus the ion detecting or filtering sensitivity is improved. Another advantage owing to the present invention is that many units of mass filters can be manufactured at one time and the manufacturing time can be rather short. This increases the manufacturing efficiency and decreases the manufacturing cost.

Other features and modifications to the above multiple-pole mass filter are fully described in the detailed description of the preferred embodiments that follow.

DETAILED DESCRIPTION OF PREFERRED EMBODIMENTS

Figure 1:
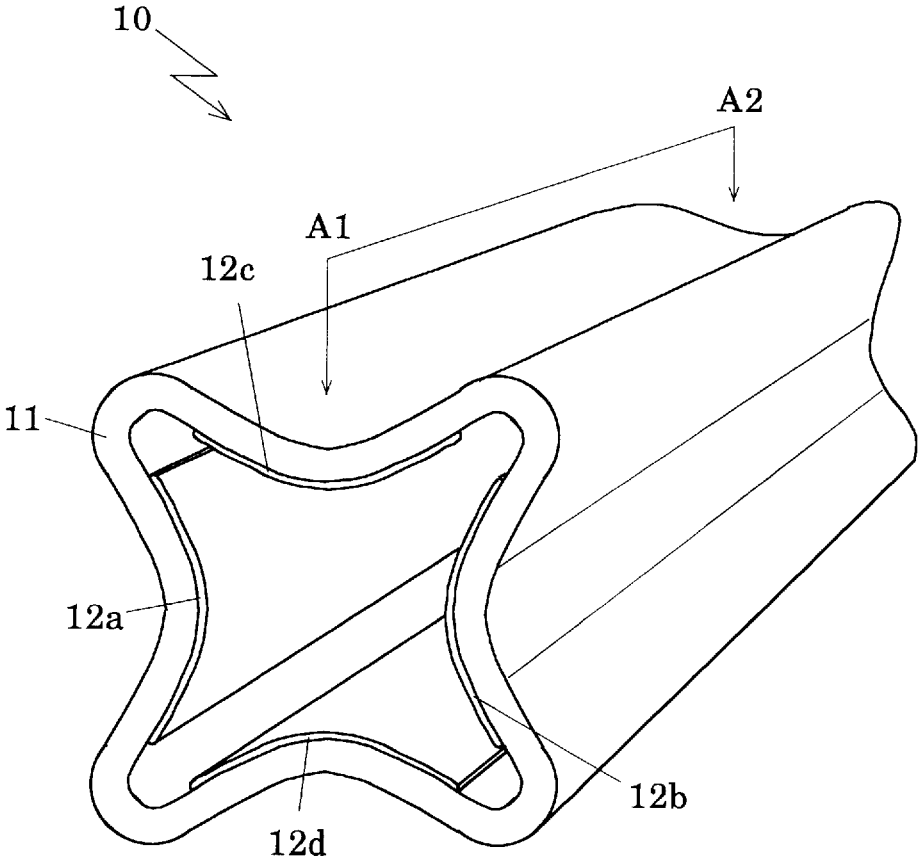
FIG. 1 is a perspective view of a quadrupole mass filter of the first embodiment.

A normal type quadrupole mass filter 10 as the first embodiment of the present invention is now described referring to FIGS. 1 to 4. The main body 11 of the quadrupole mass filter 10 is, as shown in FIG. 1, a cylinder having a cross sectional profile of a quadruped star made of quartz glass. Inside of the main body 11 are formed four electrodes 12*a*, 12*b*, 12*c* and 12*d* extending longitudinally and separated by four outward bulges. The principal requirement to the main body 11 is to be electrically non-conductive. It is also required to have a small thermal expansion coefficient to assure a high detecting sensitivity. The quartz glass is one of the most suitable materials to satisfy such requirements. The electrodes 12*a*–12*d* are made of a thin layer of conductive high melting point metal, such as tungsten, and are formed, as detailed below, by a chemical vapor deposition (CVD) method directly on the inner surface of the main body 11.

Figure 4:
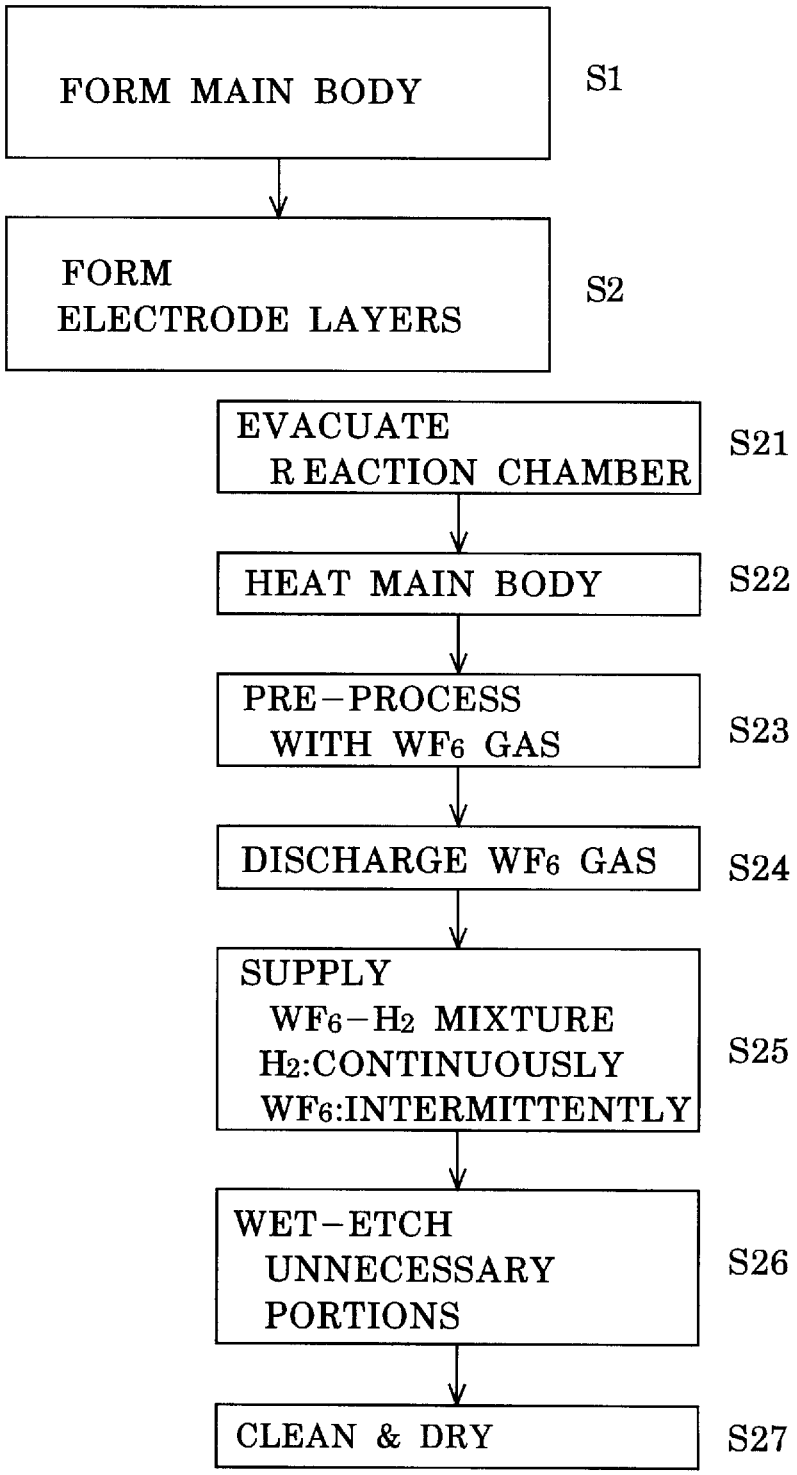
FIG. 4 is a flowchart of a process for producing the quadrupole mass filter of the first and second embodiments.

The manufacturing process of the quadrupole mass filter 10 is explained referring to the flowchart of FIG. 4. In abstract, the manufacturing process includes a step of forming the main body 11 (step S1) and a step of forming the electrodes 12*a*–12*d* (step S2) by a CVD process. In step S1, the main body 11 is formed into shape in vacuo by a known method. The electrode forming step S2 is detailed as follows.

First the main body 11 is set in a reaction chamber, and the reaction chamber is evacuated to eliminate contaminations (step S21). After the evacuation, the main body 11 is heated to 270°–380° C. (step S22). When the target temperature is attained, tungsten hexafluoride ($WF_6$) gas is supplied into the reaction chamber, and the temperature is maintained for a preset time of 10–60 minutes (step S23). This preparatory processing causes a chemical reaction on the inner surface of the main body 11 which strengthens the adhesion of the CVD layer given later.

After the preset time elapses, the $WF_6$ gas is discharged once from the reaction chamber (step S24), and hydrogen ($H_2$) gas and tungsten hexafluoride ($WF_6$) gas are again supplied into the reaction chamber to deposit a thin tungsten (W) layer on the inner surface of the main body 11 (step S25). The reactions during the above process are as follows. The oxide layer on the inner surface of the glass main body 11 is etched by the $WF_6$ gas, the $WF_6$ molecules are adsorbed on the inner surface and the fluorine is removed from the $WF_6$ molecules by the hydrogen deoxidizing process, whereby only tungsten (W) remain on the inner surface of the main body 11.

A preferable manufacturing condition is as follows. The pressure in the reaction chamber is 0.1–10 Torr, the temperature of the main body 11 is 270°–380° C. The hydrogen ($H_2$) gas is supplied continuously into the reaction chamber at the rate of 30–400 $ml.min^{-1}$, and the tungsten hexafluoride ($WF_6$) gas is supplied into the reaction chamber intermittently at the rate of 10–400 $ml.min^{-1}$. Specifically, a three-minute cycle is repeated for about 60 minutes where the tungsten hexafluoride ($WF_6$) gas is supplied for two minutes and is halted one minute in the three-minute cycle. In such an intermittent supplying method, the $WF_6$ gas can easily disperse within the reaction chamber when the gas is supplied after it is once halted, which improves the uniformity in the thickness of the tungsten layer, i.e., the difference in the thickness between that near the gas inlet and that far from the gas inlet is reduced. For this purpose, the hydrogen ($H_2$) gas may also be supplied intermittently at the same timing with the $WF_6$ gas.

When the above favorable conditions are satisfied, a very thin and uniform tungsten layer of about 0.2–1 $\mu$m thickness can be obtained. After the tungsten layer is formed, unnecessary portions of the layer are removed by the wet-etching method (step S26). Specifically, the portions where the tungsten layer should be maintained are covered by a resist mask or by a rubber mask, and the remaining portions, i.e., the outside surface of the main body 11 and the four outward bulges, are contacted by hydrogen peroxide ($H_2O_2$) to wash off the tungsten layer. After the unnecessary tungsten layer is removed, the resist mask or the rubber mask is removed to reveal the main body 11 with the four electrodes 12*a*–12*d* made of thin uniform tungsten. Instead of removing unnecessary portions after the tungsten layer is entirely formed as described above, such unnecessary portions may be masked before the CVD process.

After the unnecessary portions are etched, the main body 11 is thoroughly cleaned and dried (step S27). The drying can be done in vacuo at the temperature of about 300° C., for example.

Figure 2A:
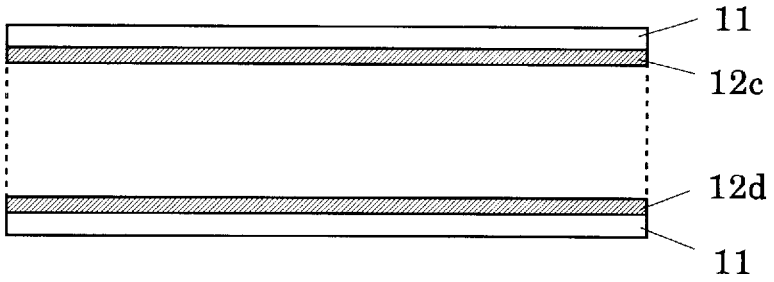
FIGS. 2A–2C are longitudinal cross-sectional views of the quadrupole mass filter of the first embodiment and its modifications.
Figure 2B:
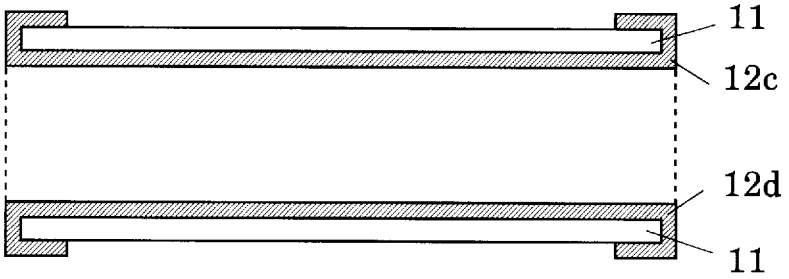
Figure 2C:
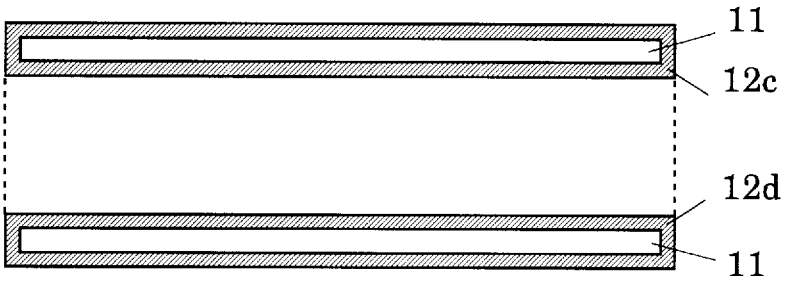

The electrodes 12*a*–12*d* of the quadrupole mass filter 10 shown in FIG. 1 is confined to the inside of the main body 11 as shown in FIG. 2A, which is the cross sectional view at the line A1-A2 of FIG. 1. It is preferable, actually, to form the electrodes 12*a*–12*d* as shown in FIG. 2B or 2C to provide terminals for lead wires to the electrodes 12*a*–12*d*. The electrodes 12*a*–12*d* of FIG. 2B extend to a part of the outside surface. This form is favorable when a DC voltage or a DC plus high-frequency AC voltage is applied to the electrodes 12*a*–12*d*. In FIG. 2C, each electrode band 12*a*–12*d* raps around the outside surface to form a continuous loop and is also separate from each other. This form is favorable when a high-frequency AC voltage alone is applied to the electrodes 12*a*–12*d*. Electrodes of both FIG. 2B and 2C can be formed with the same manner as described above by etching appropriate unnecessary portions after the CVD process or masking appropriate unnecessary portions before the CVD process.

Figure 3:
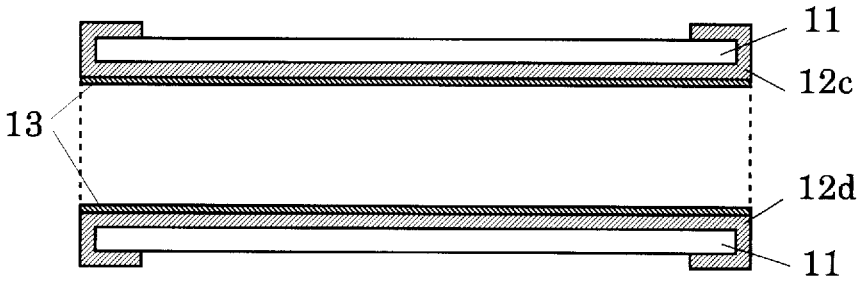
FIG. 3 is a cross-sectional view of another modification to the quadrupole mass filter of the first embodiment.

A preferable modification to the multiple-pole mass filter of the present invention is that a very thin layer 13 of anti-corrosive metal covers the part of the tungsten electrodes 12*a*–12*d* that faces inside of the main body 11, as shown in FIG. 3. This is because the part of the electrodes 12*a*–12*d* can suffer attack by corrosive gas when ions are separated by the quadrupole mass filter 10. An example of the anti-corrosive layer 13 is a rhenium (Re) layer of 0.01–0.3 $\mu$m thickness. The rhenium layer can also be made by a CVD process similar to that described above for the tungsten layer, where $ReF_6$ gas is used instead of $WF_6$ gas in the deoxidation process. Various conditions for rhenium CVD process can be almost the same as those in the tungsten CVD process, but the processing temperature is preferred to be somewhat lower, e.g., at about 170° C.

It is of course possible to make the rhenium layer thicker, or to cover the entire surface of the tungsten electrodes 12*a*–12*d* with the rhenium layer. But, in general, metals that can be used for the anti-corrosive layer are more expensive than those used for the electrodes 12*a*–12*d*. Thus it is practical to minimize the amount of rhenium. If, on the other hand, the cost allows, the electrodes 12*a*–12*d* themselves can be made of an anti-corrosive metal such as rhenium.

Another modification is as follows. After depositing a tungsten layer of 0.01–0.3 $\mu$m thickness on the main body 11 as described above, an electroplating of nickel (Ni), chromium (Cr), gold (Au), etc. is made on the tungsten layer. Though this requires two different processes of CVD and electroplating, the layer formed by the CVD process can be very thin, whereby the overall processing time can be reduced and the manufacturing efficiency is improved.

Figure 5:
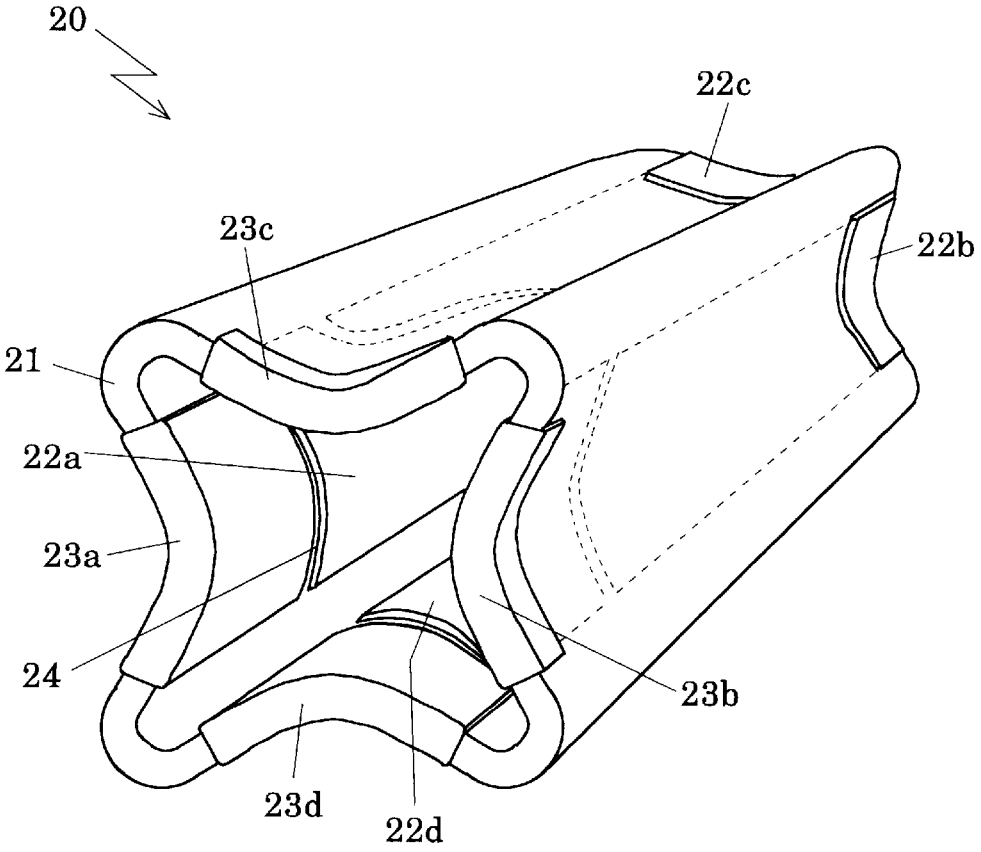
FIG. 5 is a perspective view of a quadrupole mass filter of the second embodiment.
Figure 6:
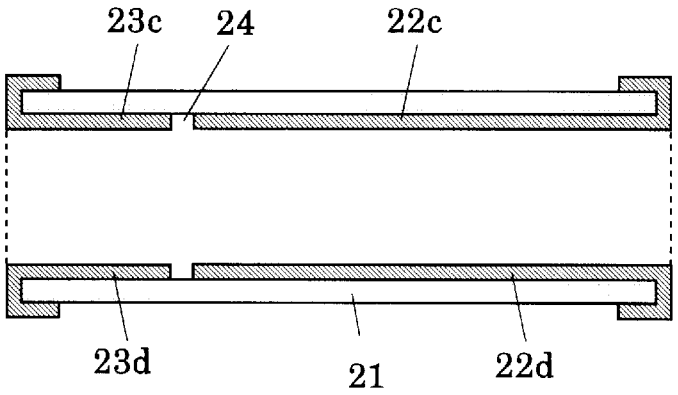
FIG. 6 is a longitudinal cross-sectional view of the quadrupole mass filter of the second embodiment.

A pre-rod type quadrupole mass filter is then described referring to FIGS. 5 to 8 as the second embodiment of the present invention. The main body 21 of the quadrupole mass filter 20 is, as shown in FIG. 5, the same as used in the previous embodiment shown in FIG. 1, but the electrode configuration is different. Inside of the main body 21 are formed four main electrodes 22*a*, 22*b*, 22*c* and 22*d* and four pre-rod electrodes 23*a*, 23*b*, 23*c* and 23*d*. The main electrodes 22*a*–22*d* and pre-rod electrodes 23*a*–23*d* are respectively separated by four outward bulges as described before, and they are separated from each other by a circumferential gap 24 placed at an appropriate longitudinal position of the main body 21. The outer end of each of the electrodes 22*a*–22*d* and 23*a*–23*d* extends to the outside surface of the main body 21, on which a lead wire is bonded.

The requirements to the main body 21 and the electrodes 22*a*–22*d*, 23*a*–23*d* are the same as those cited above for the first embodiment, and the same material can be used here of course.

The manufacturing process of the quadrupole mass filter 20 of the second embodiment until the tungsten layer is deposited is the same as that explained for the first embodiment using flowchart of FIG. 4 (steps S1 to S25). Then the process for removing unnecessary portions, i.e., the process for forming the shape of electrodes, (step S26) is different. The portions where the tungsten layer should be maintained, i.e., the main electrode portions 22*a*–22*d* and the pre-rod electrode portions 23*a*–23*d*, are covered by a resist mask or by a rubber mask, and the remaining portions, i.e., outside surface of the main body 21, the four outward bulges and the gap 24, are contacted by hydrogen peroxide ($H_2O_2$) to wash off the tungsten layer. After the unnecessary tungsten layer is removed, the resist mask or the rubber mask is removed to obtain the main body 21 with the four main electrodes 22*a*–22*d* and the four pre-rod electrodes 23*a*–23*d* made of thin uniform tungsten. Instead of removing unnecessary portions after the tungsten layer is entirely formed as described above, such unnecessary portions may be masked before the CVD process.

The rubber mask may be composed of three parts, one for a simple-shaped part of the main body 21 and the other two for irregularly-shaped part, such as the edge parts, of the main body 21. It is preferable that the simple-shaped part of the rubber mask is made of solid rubber with a stainless steel backing, and the irregularly-shaped parts are made of solidifiable fluid type rubber such as the RTV rubber (room temperature vulcanizing silicone rubber). The solid rubber mask is suited when a straight-line edge is required, so that it is better used in forming the gross shape of the electrodes 22*a*–22*d* and 23*a*–23*d*.

After the unnecessary portions are etched, the main body 21 is thoroughly cleaned and dried as described above (step S27).

Figure 7:
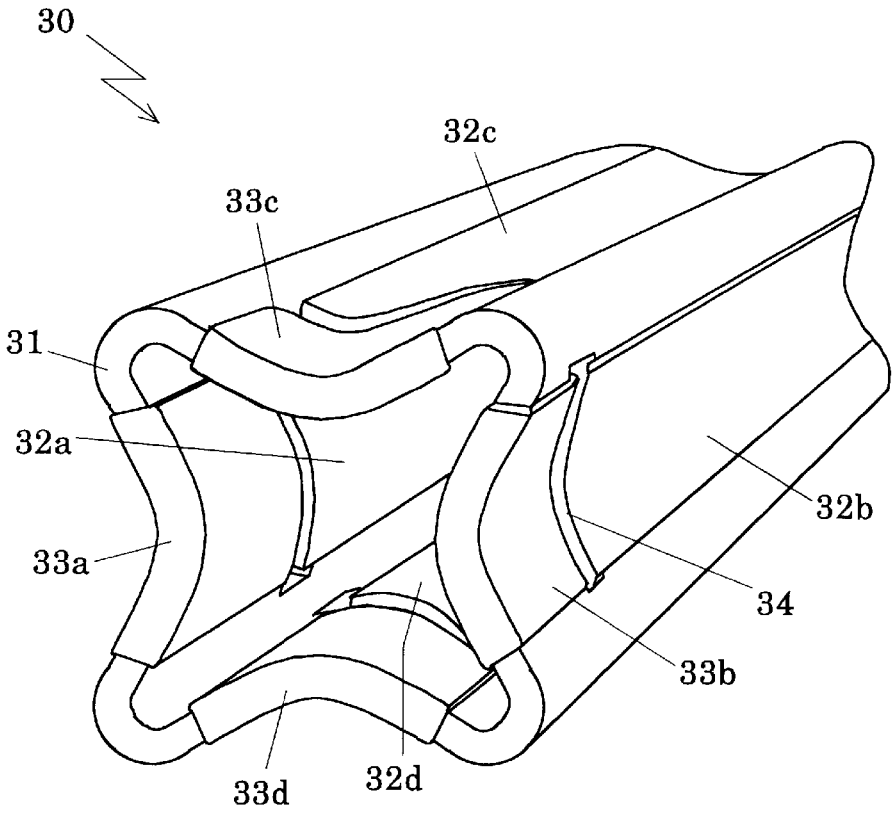
FIG. 7 is a perspective view of a modification to the quadrupole mass filter of the second embodiment.
Figure 8:
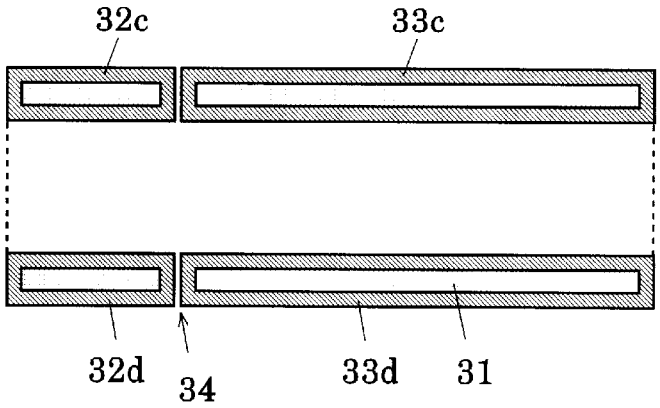
FIG. 8 is a longitudinal cross-sectional view of the quadrupole mass filter of FIG. 7.
Figure 9:
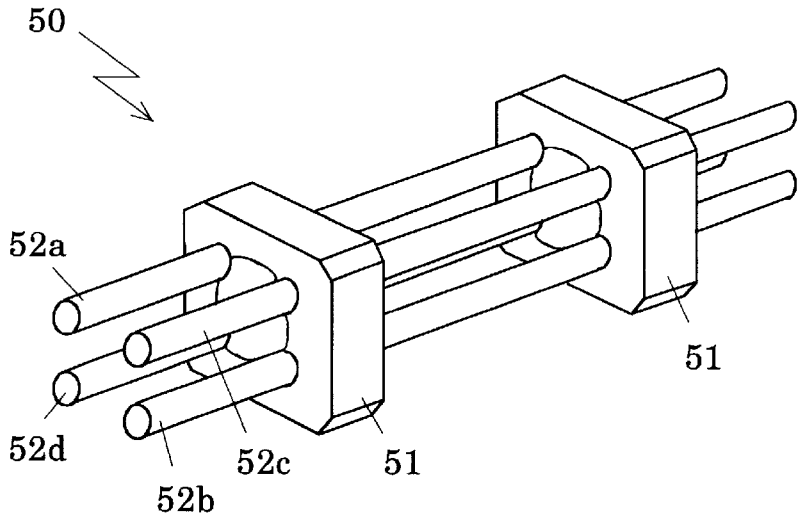
Fig. 9 PRIOR ART
FIG. 9 is a perspective view of a conventional normal type quadrupole mass filter.
Figure 11:
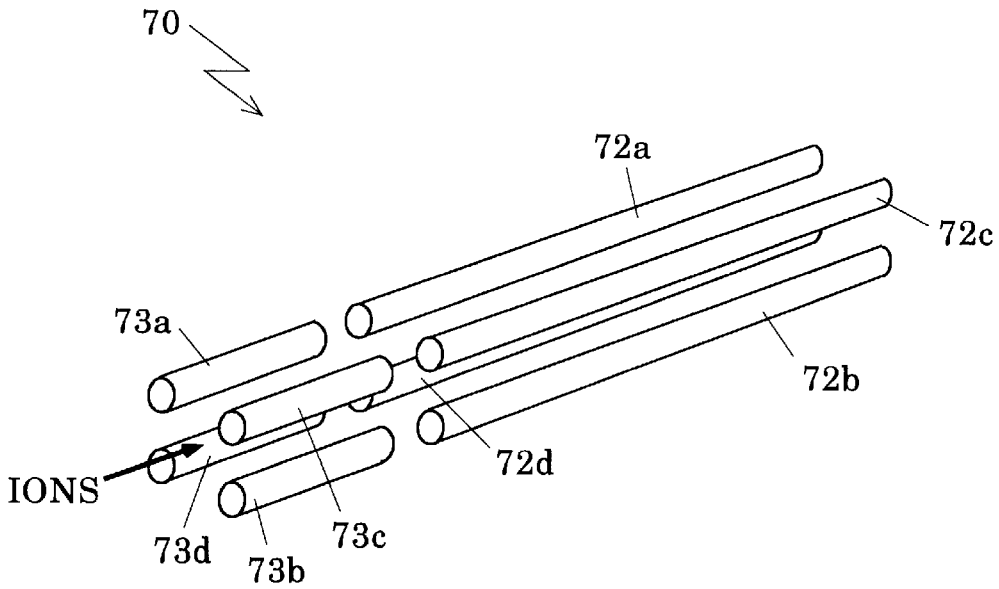
Fig. 11 PRIOR ART
FIG. 11 is a a perspective view of a conventional pre-rod type quadrupole mass filter.
Figure 10A:
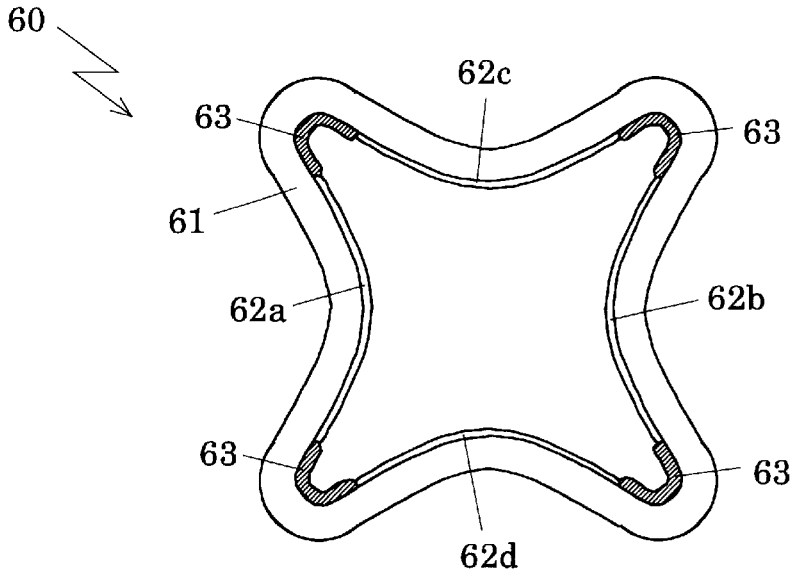
Fig.10A PRIOR ART
FIGS. 10A and 10B are transverse cross-sectional views of conventional cylindrical quadrupole mass filters.
Figure 10B:
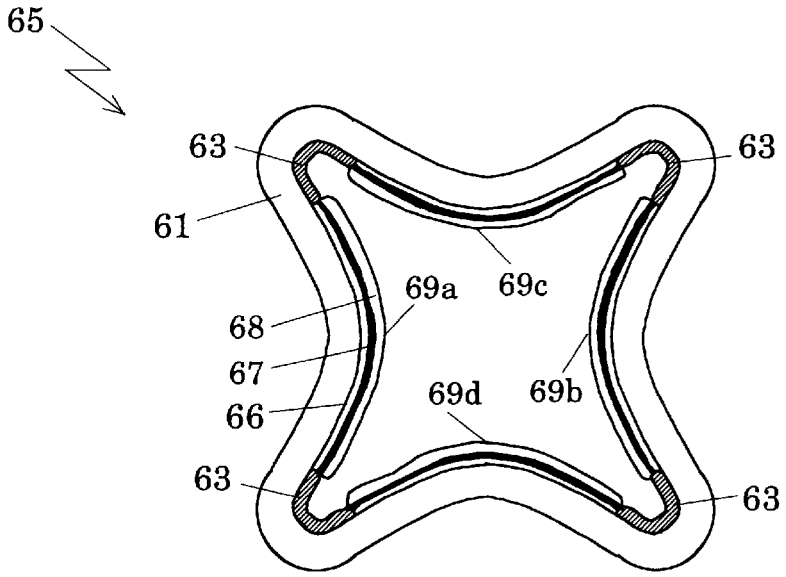
Fig.10B PRIOR ART

A preferable modification to the multiple-pole mass filter of the second embodiment is shown in FIGS. 7 and 8. For separating the main electrodes 32*a*–32*d* and the pre-rod electrodes 33*a*–33*d*, the main body 31 of quadrupole mass filter 30 has cuts 34 in itself. As shown in FIG. 8, the electrodes 32*a*–32*d*, 33*a*–33*d* cover the entire surface of the main body 31 except the separating part of the four outward bulges.

The quadrupole mass filter 30 of FIG. 7 can be manufactured by adding a cutting process before the electrode layer is deposited. Specifically, the four cuts 34 are made at the preset place after the main body 31 is formed by quartz glass. Then the metal layer is deposited on the entire surface including the inner surface of the cuts 34. After the metal layer is formed on the entire surface and unnecessary portions are removed by etching, the electrode portions 32*a*–32*d* and 33*a*–33*d* are left on the main body 31.

As described before for the first embodiment, a very thin layer 13 of anti-corrosive metal may cover the part of the tungsten electrodes 22*a*–22*d*, 23*a*–23*d*, 32*a*–32*d* and 33*a*–33*d* that faces inside of the main body 21 and 31. And further it is also possible to electroplate nickel (Ni), chromium (Cr), gold (Au), etc. on the tungsten layer.

What is claimed is:

1. A multiple-pole mass filter comprising:

a cylindrical main body made of an insulating material having a star-shaped cross-sectional profile whose inward bulges are curved substantially hyperbolic; and an electrode layer of a high melting point metal deposited by a chemical vapor deposition (CVD) process on each of the inward bulges, wherein neighboring electrode layers are separated at an outward bulge of the star-shaped cross-sectional profile between the neighboring electrode layers, each of the electrode layers extending to an outside surface of the main body from an end of the main body for a lead wire to be bonded on the electrode layer.

2. The multiple-pole mass filter according to claim 1, wherein the insulating material is quartz glass.

3. The multiple-pole mass filter according to claim 1, wherein the high melting point metal is tungsten.

4. The multiple-pole mass filter according to claim 1, wherein the electrode layer extends to an entire outside surface of the main body while neighboring electrode layers are still separated at the outward bulge in between.

5. The multiple-pole mass filter according to claim 1, wherein at least a part of the electrode layer that is inside of the main body is covered by an anti-corrosive metal layer deposited by a CVD process.

6. The multiple-pole mass filter according to claim 5, wherein the anti-corrosive metal layer is a rhenium layer.

7. The multiple-pole mass filter according to claim 1, wherein at least a part of the electrode layer that is inside of the main body is covered by an electroplated anti-corrosive metal layer.

8. The multiple-pole mass filter according to claim 7, wherein the electroplated anti-corrosive metal layer is a nickel layer.

9. The multiple-pole mass filter according to claim 7, wherein the electroplated anti-corrosive metal layer is a chromium layer.

10. The multiple-pole mass filter according to claim 7, wherein the electroplated anti-corrosive metal layer is a gold layer.

11. A multiple-pole mass filter comprising:

a cylindrical main body made of an insulating material having a star-shaped cross-sectional profile whose inward bulges are curved substantially hyperbolic;

a main electrode layer of a high melting point metal deposited by a chemical vapor deposition (CVD) process on each of the inward bulges, wherein neighboring electrode layers are separated at an outward bulge of the star-shaped cross-sectional profile between the neighboring electrode layers; and a pre-rod electrode layer of a high melting point metal, deposited by a same chemical vapor deposition (CVD) process as the main electrode layer on each of the inward bulges, adjacent to and separated from the main electrode layer with a gap in between.

12. The multiple-pole mass filter according to claim 11, wherein the gap is a cut formed in the main body.

* * * * *